US007717807B2

(12) United States Patent
Evans et al.

(10) Patent No.: US 7,717,807 B2
(45) **Date of Patent: *May 18, 2010**

(54) GOLF CLUB HEAD WITH TUNGSTEN ALLOY SOLE APPLICATIONS

(75) Inventors: D. Clayton Evans, San Marcos, CA (US); Larry G. Tang, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 32 days.

This patent is subject to a terminal disclaimer.

(21) Appl. No.: 12/202,538

(22) Filed: Sep. 2, 2008

(65) Prior Publication Data

US 2009/0082135 A1 Mar. 26, 2009

Related U.S. Application Data

(60) Provisional application No. 60/970,422, filed on Sep. 6, 2007.

(51) Int. Cl.
*A63B 53/04* (2006.01)

(52) U.S. Cl. ..... 473/345; 473/344; 473/349

(58) Field of Classification Search ..... 473/324–350
See application file for complete search history.

(56) References Cited

U.S. PATENT DOCUMENTS 4,429,879 A * 2/1984 Schmidt ..... 473/346
5,028,049 A * 7/1991 McKeighen ..... 473/345
5,447,309 A 9/1995 Vincent
5,582,553 A * 12/1996 Ashcraft et al. ..... 473/345
5,658,207 A * 8/1997 Aizawa et al. ..... 473/345
5,665,014 A 9/1997 Sanford et al.
5,785,605 A 7/1998 Helmstetter
5,911,102 A 6/1999 Takahashi et al.
5,931,742 A * 8/1999 Nishimura et al. ..... 473/305
5,967,905 A * 10/1999 Nakahara et al. ..... 473/345
5,971,867 A * 10/1999 Galy ..... 473/345
5,985,208 A 11/1999 Zedalis et al.
5,989,493 A 11/1999 La Salle et al.
6,012,990 A * 1/2000 Nishizawa ..... 473/345
6,027,686 A 2/2000 Takahashi et al.
6,149,534 A * 11/2000 Peters et al. ..... 473/345

(Continued)

FOREIGN PATENT DOCUMENTS

JP 02191476 A * 7/1990

(Continued)

*Primary Examiner*—Alvin A Hunter
(74) *Attorney, Agent, or Firm*—Michael A. Catania; Elaine H. Lo

(57) ABSTRACT

A wood-type golf club head (20) with a main body (22) and a minor body (24) is disclosed herein. The main body (26) has a front portion (30), a crown portion (25), a partial toe portion (27), a partial heel portion (26), a partial rear portion (28) and a partial sole portion (29). The minor body (24) preferably has a sole wall (31), a partial toe wall (33), a partial heel wall (32) and a partial rear wall (34). The minor body (24) is preferably welded to the main body (22). The minor body (24) preferably has a mass ranging from 80 grams to 110 grams. The minor body (24) is preferably from 50 weight percent to 35 weight percent of the total mass of the wood-type golf club head (20).

6 Claims, 10 Drawing Sheets

U.S. PATENT DOCUMENTS 6,322,746 B1 11/2001 La Salle et al.
6,334,817 B1 * 1/2002 Ezawa et al. ..... 473/324
6,350,407 B1 2/2002 Sakata et al.
6,364,788 B1 4/2002 Helmstetter et al.
6,409,612 B1 6/2002 Evans et al.
6,440,009 B1 * 8/2002 Guibaud et al. ..... 473/334
6,478,842 B1 11/2002 Gressel et al.
6,669,898 B2 12/2003 Gressel et al.
6,739,983 B2 5/2004 Helmstetter et al.
6,767,418 B1 7/2004 Zhang et al.
7,041,189 B2 * 5/2006 Caldwell et al. ..... 156/242
7,229,362 B2 * 6/2007 Tavares ..... 473/349
7,347,796 B2 * 3/2008 Takeda ..... 473/345
7,396,296 B2 * 7/2008 Evans ..... 473/344
7,481,720 B2 * 1/2009 Tavares ..... 473/345

FOREIGN PATENT DOCUMENTS

JP 07163687 A * 6/1995
JP 10234890 A * 9/1998
JP 10263122 A * 10/1998
JP 2001000598 A * 1/2001
JP 2001212272 A * 8/2001
JP 2002052100 A * 2/2002
JP 2005080724 A * 3/2005

* cited by examiner

GOLF CLUB HEAD WITH TUNGSTEN ALLOY SOLE APPLICATIONS

CROSS REFERENCES TO RELATED APPLICATIONS

The Present Application claims priority to U.S. Patent Application No. 60/970,422, filed Sep. 6, 2007.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head with a sole component entirely composed of a tungsten alloy material.

2. Description of the Related Art

Present day golf clubs are typically composed of titanium or steel, and either cast or forged. Various patents have disclosed the use of multiple material golf club heads, generally combining a metal with a non-metal. Various patents have disclosed the use of metal injection molding for golf clubs.

Sanford et al., U.S. Pat. No. 5,665,014, for a Metal Golf Club Head And Method Of Manufacture, discloses a golf club head with two components with at least one of the components composed of a metal injection molded material.

Gressel et al., U.S. Pat. No. 6,478,842, for a Preparation Of Articles Using Metal Injection Molding, discloses an entire golf club head composed of a metal injection molded material having a stainless steel and tungsten alloy composition.

Gressel et al., U.S. Pat. No. 6,669,898, for a Preparation Of Articles Using Metal Injection Molding, discloses forming an entire golf club head composed of a metal injection molded material having a stainless steel and tungsten alloy composition.

Zhang et al., U.S. Pat. No. 6,767,418, for a TI-ZR Type Alloy And Medical Appliance Formed Thereof, discloses a titanium-zirconium alloy that may be used for golf club components.

Sakata et al, U.S. Pat. No. 6,350,407, for a Process For Producing Sintered Product, discloses a process for metal injection molding.

LaSalle et al., U.S. Pat. No. 6,322,746, for a Co-Sintering Of Similar Materials, discloses a process of fusing two dissimilar material parts through use of co-sintering including a golf putter.

Takahashi et al., U.S. Pat. No. 6,027,686, for a Method Of Manufacturing Sintered Compact, discloses sintering a green body formed by metal injection molding.

LaSalle et al., U.S. Pat. No. 5,989,493, for a Net Shape Hastelloy X Made By Metal Injection Molding Using An Aqueous Binder, discloses metal injecting a Hastelloy X powder.

Zedalis et al., U.S. Pat. No. 5,985,208, for a Process For Debinding And Sintering Metal Injection Molded Parts Made With An Aqueous Binder, discloses metal injection molding a 17-4PH stainless steel alloy.

Takahashi et al., U.S. Pat. No. 5,911,102, for a Method Of Manufacturing Sintered Compact, discloses sintering a green body formed by metal injection molding.

Numerous techniques have been used for weighting golf club heads in order to gain better performance. In persimmon wood club heads, weights were attached to the sole in order to lower the center of gravity. The first metal woods had sufficient weight, however, the weight distribution deterred slightly from performance. The refinement of hollow metal woods with weighting on the sole improved upon the performance of these clubs. An example of such woods were the GREAT BIG BERTHA® HAWK EYE® drivers and fairway woods, developed by the Callaway Golf Company of Carlsbad, Calif., that used a tungsten screw in the sole of each titanium club head body to vary the weight of the golf club head.

Another example is set forth in Helmstetter et al., U.S. Pat. No. 6,364,788, for a Weighting System For A Golf Club Head, which discloses using a bismuth material within an internal cavity to add mass to a golf club head, particularly a fairway wood.

Yet a further example is set forth in Evans et al., U.S. Pat. No. 6,409,612, for a Weighting Member For A Golf Club Head, which discloses a weighting device composed of a polymer body with ports to allow for placement of high density members such as tungsten spheres.

Another example of additional weighting of a golf club head is set forth in U.S. Pat. No. 5,447,309, which discloses the use of three weights fixedly disposed within the interior of a club head to provide a selected moment of inertia for the club head. Yet another example is set forth in British Patent Application Number 2332149 for a Golf Club Head With Back Weighting Member, which discloses a weight pocket in the exterior rear of a wood for placement of epoxy inserts that vary in density.

An example of positioning mass in a golf club head for performance is disclosed in Helmstetter et al., U.S. Pat. No. 6,739,983, for a Golf Club Head With Customizable Center Of Gravity, which discloses a method and golf club head which allows a golfer to select a preferred center of gravity location for better ball striking.

A further example of positioning mass for performance is set forth in Helmstetter, U.S. Pat. No. 5,785,605 for a Hollow, Metallic Golf Club Head With Configured Medial Ridge, which discloses a golf club head with a center of gravity located in vertical alignment with a local zone defined by ridge on a sole of the golf club head.

The prior art fails to disclose a means for using a metal injection molded part for performance weighting of a golf club head.

BRIEF SUMMARY OF THE INVENTION

The present invention provides a golf club head with performance weighting through use of a sole component composed of a tungsten alloy material.

One aspect of the present invention is a wood-type golf club head comprising a main body and a minor body. The main body comprises a front portion, a crown portion, a partial toe portion, a partial heel portion, a partial rear portion and a partial sole portion. The main body is composed of a stainless steel material. The main body has a mass ranging from 100 grams to 150 grams. The minor body is attached to the main body. The minor body comprises a sole wall, a partial toe wall, a partial heel wall and a partial rear wall. The partial toe wall is welded to the partial toe portion. The partial heel wall is welded to the partial heel portion. The partial rear wall is welded to the partial rear portion. The sole wall is welded to the partial sole portion. The minor body is composed of a tungsten alloy material. The tungsten alloy material comprises iron and tungsten. The minor body has a mass ranging from 80 grams to 100 grams. The golf club head has a mass ranging from 200 grams to 250 grams.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
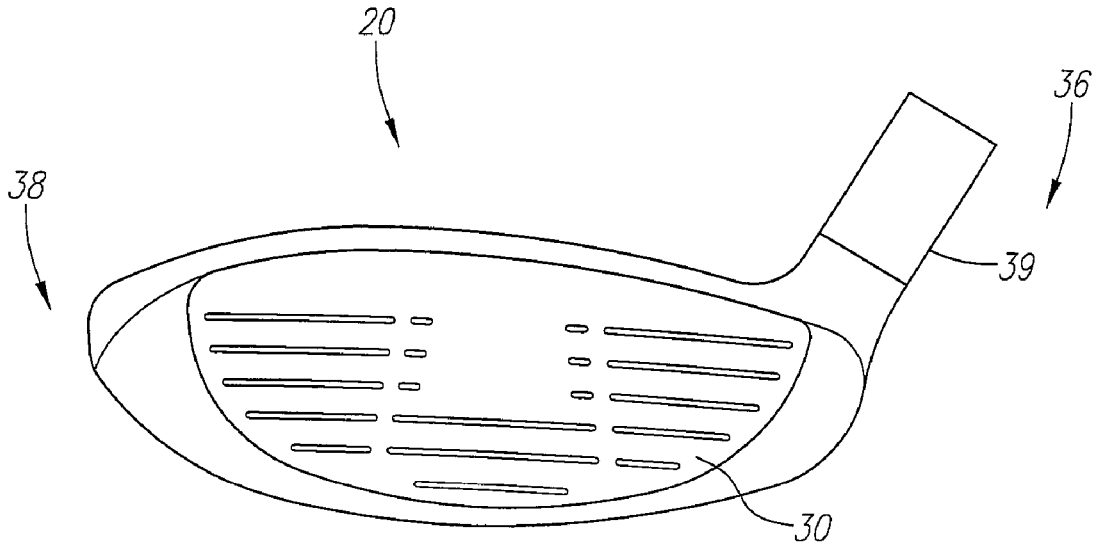
FIG. 1 is a front elevational view of a golf club head.
Figure 2:
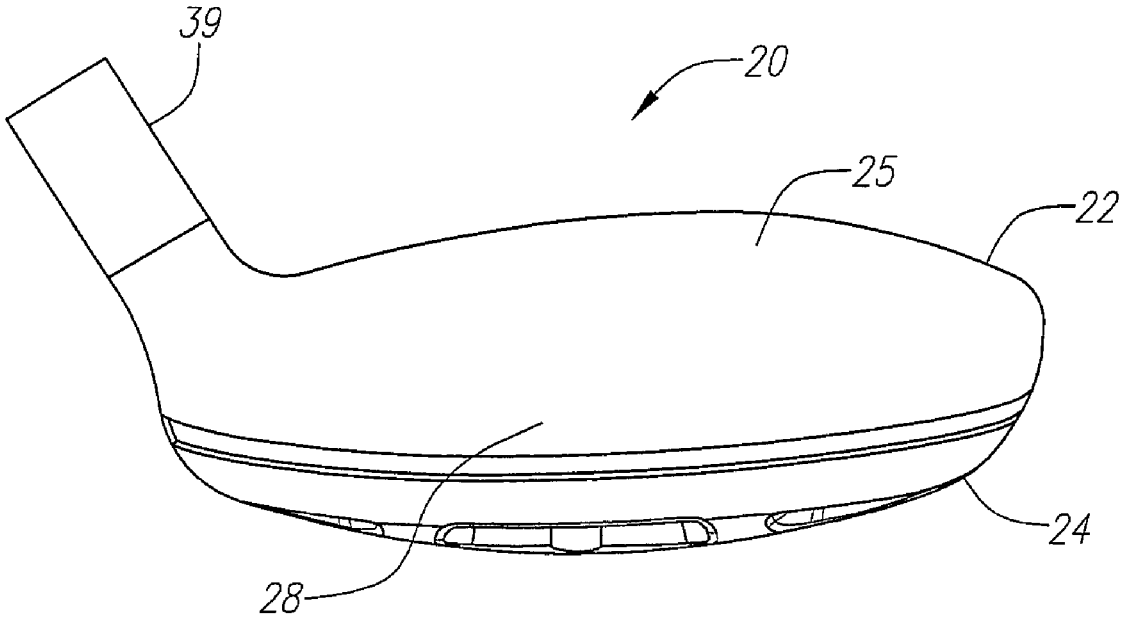
FIG. 2 is a rear elevational view of a golf club head.
Figure 3:
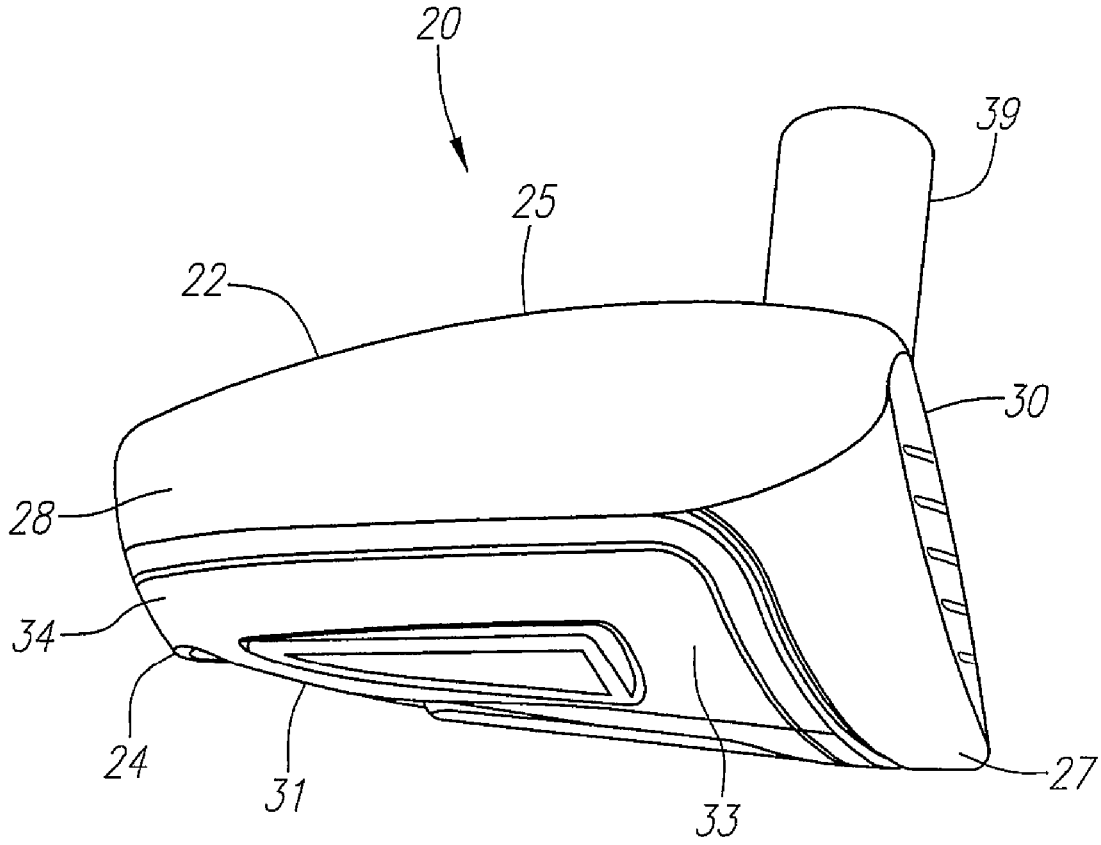
FIG. 3 is a toe-side view of a golf club head.
Figure 4:
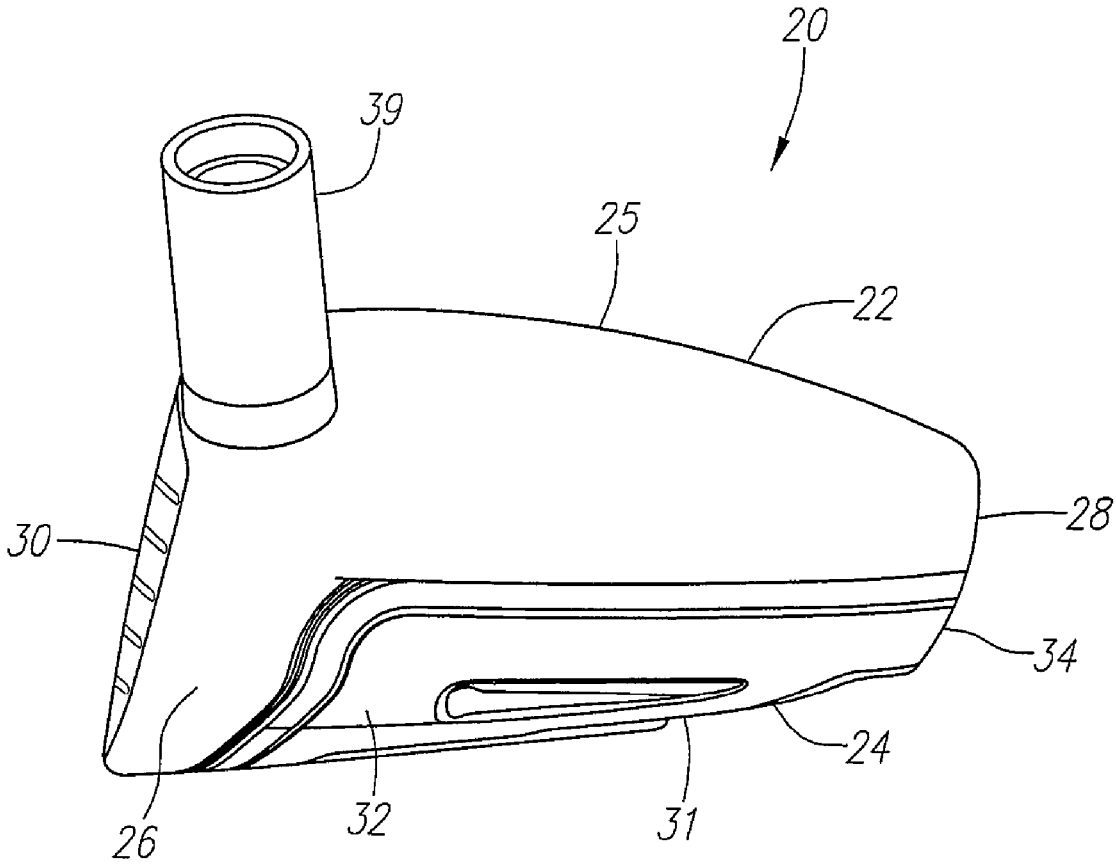
FIG. 4 is heel-side view of a golf club head.
Figure 5:
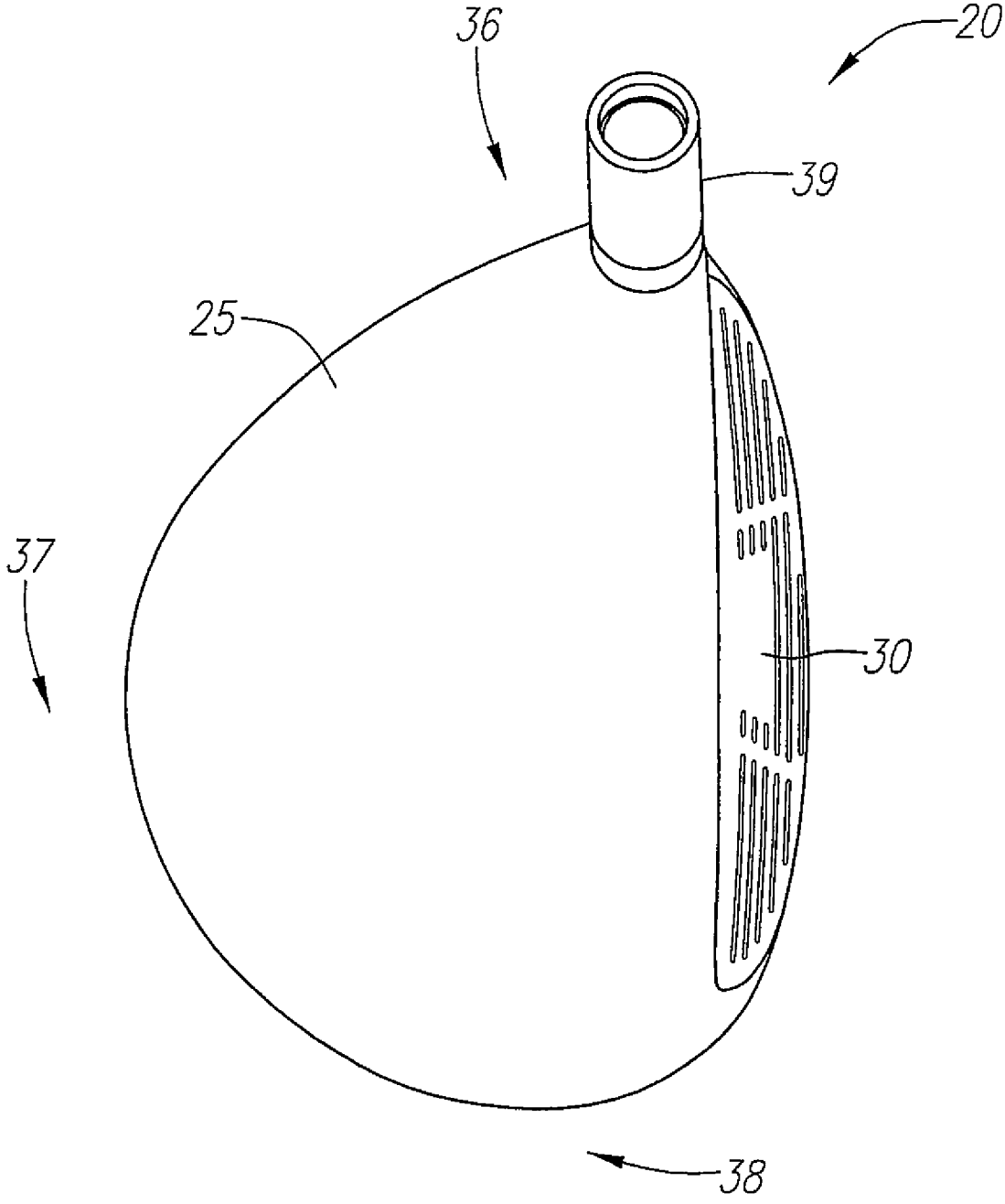
FIG. 5 is top plan view of a golf club head.
Figure 6:
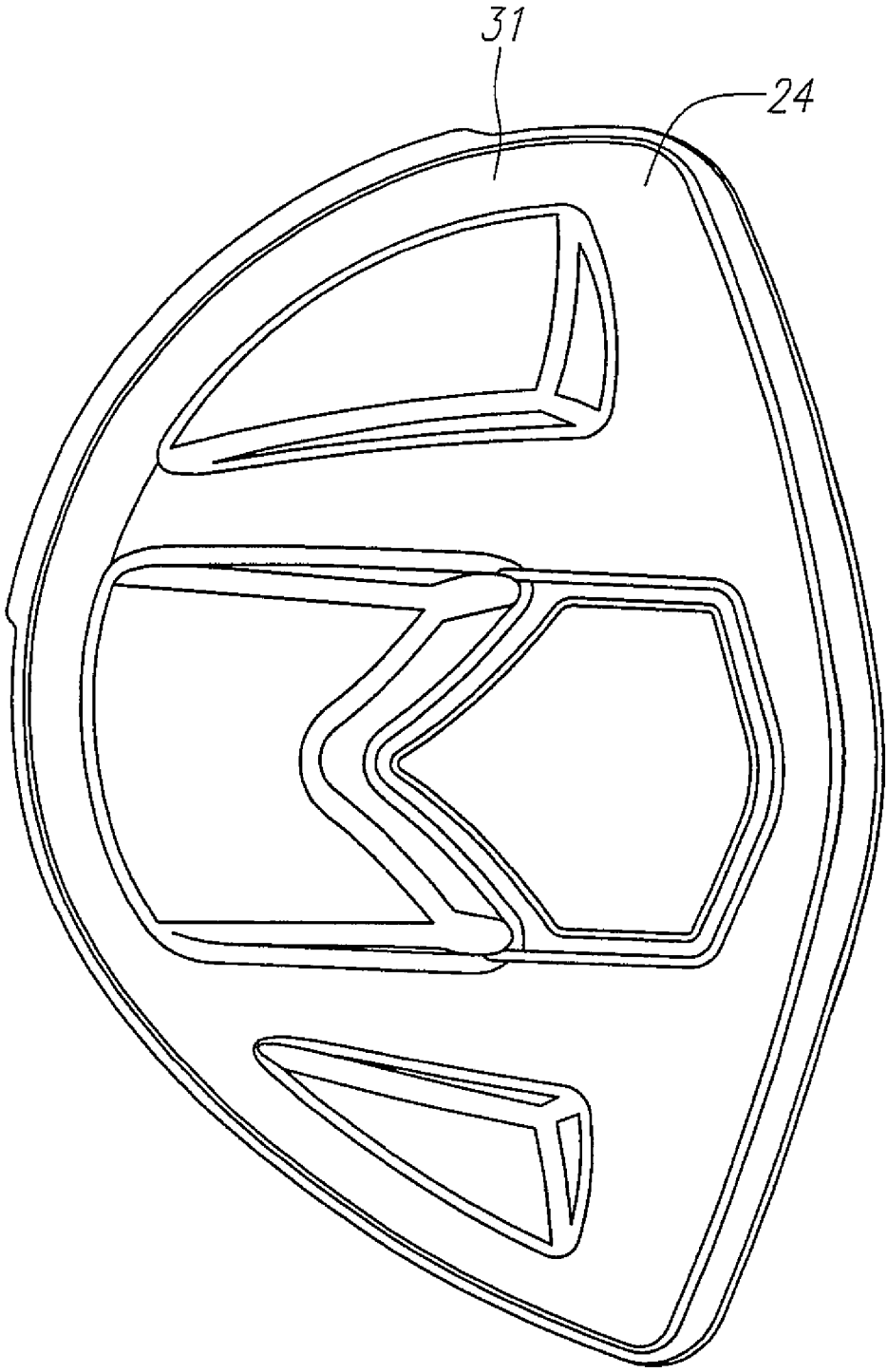
FIG. 6 is bottom plan view of a golf club head.
Figure 7:
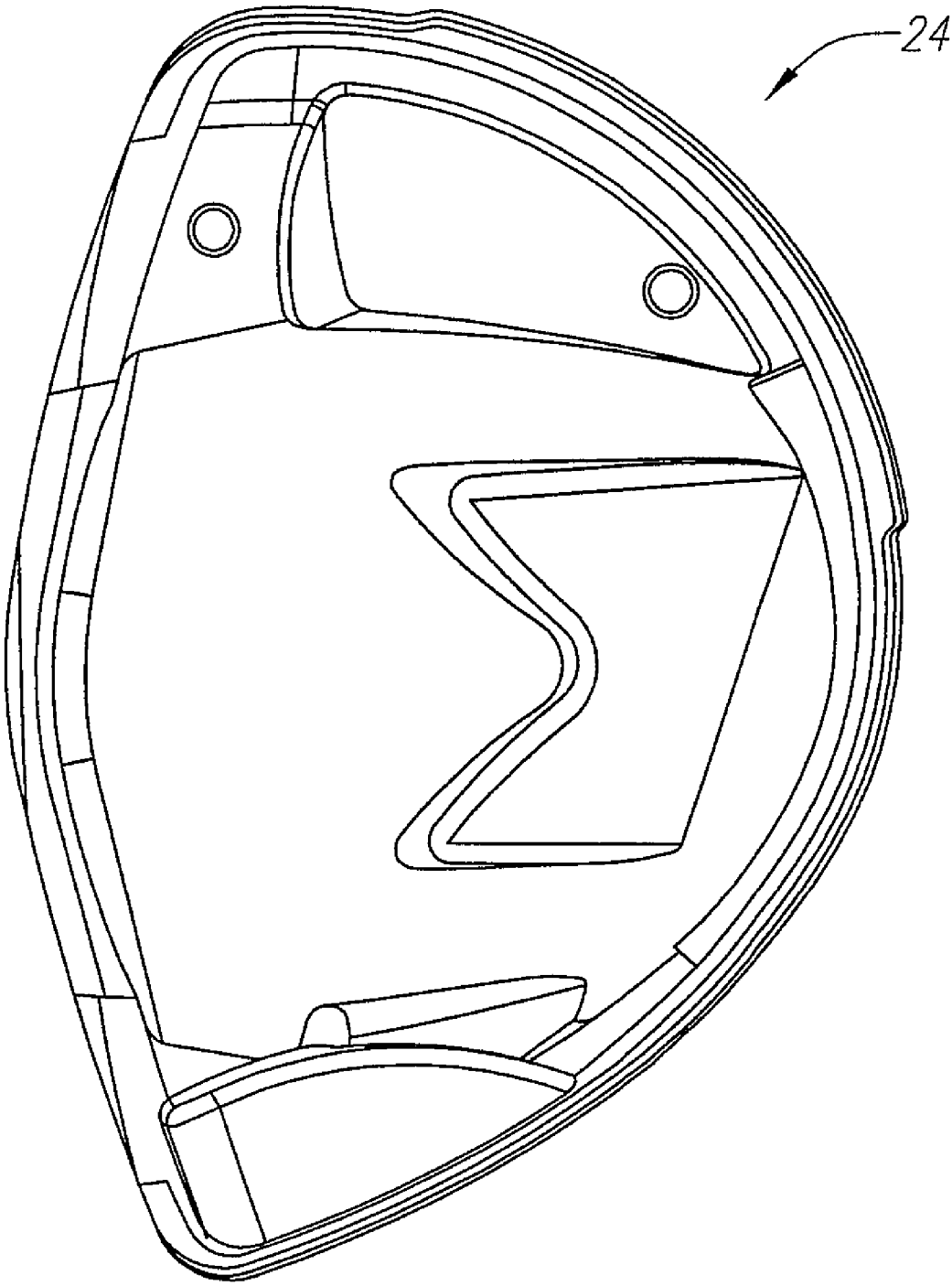
FIG. 7 is an isolated interior view of a minor body of a golf club head.
Figure 8:
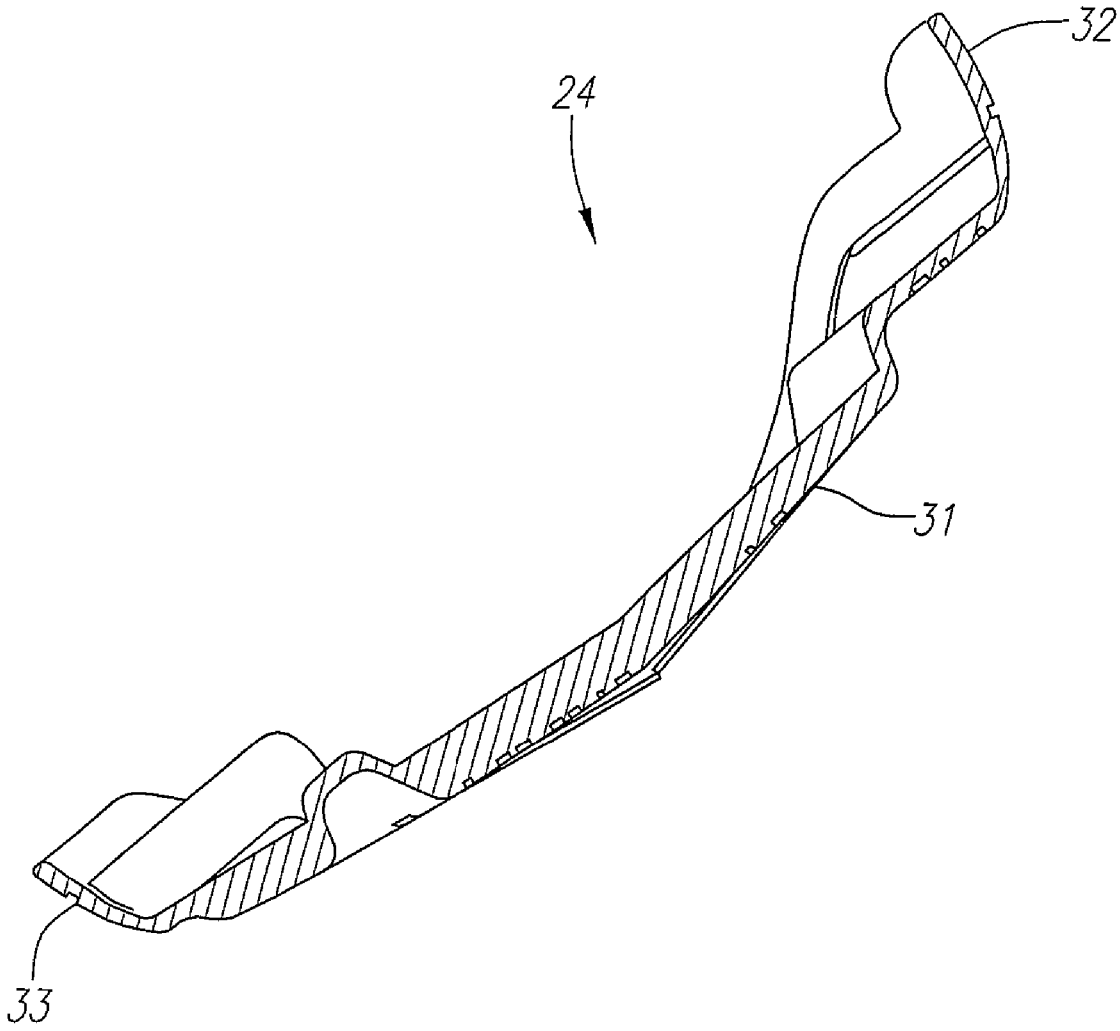
FIG. 8 is an isolated cross-sectional view of a minor body of a golf club head.
Figure 9:
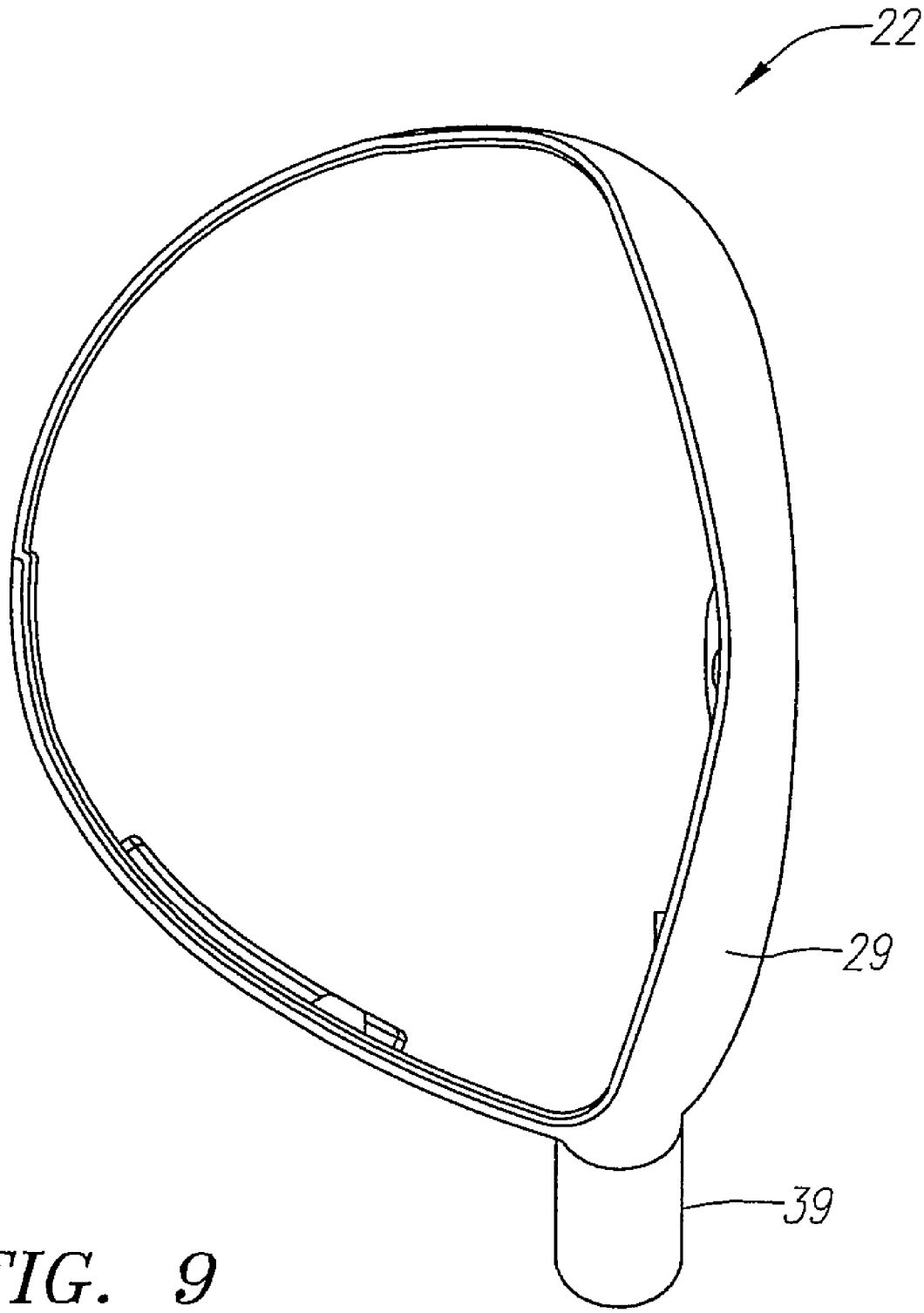
FIG. 9 is an isolated interior view of a major body of a golf club head.
Figure 10:
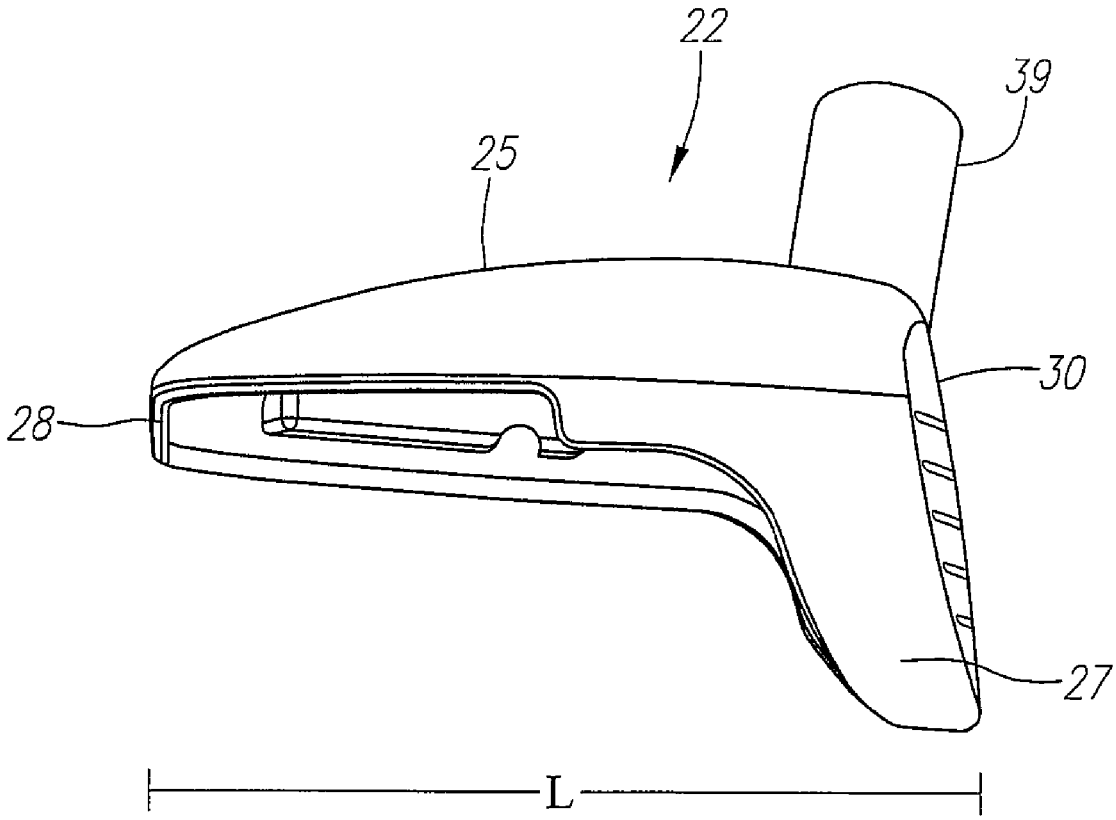
FIG. 10 is an isolated toe-side view of a major body of a golf club head.

As shown in FIGS. 1-5, a golf club head is generally designated 20. The golf club head 20 of FIGS. 1-5 is a fairway wood, however, the golf club head 20 of the present invention may alternatively be a driver. The golf club head 20 preferably has two main components: a main body 22 and a minor body 24. The main body 22 is preferably composed of a metal material such as titanium, titanium alloy, stainless steel, or the like, and is most preferably composed of a cast stainless steel material. The main body 22 is preferably cast from molten metal in a method such as the well-known lost-wax casting method. The metal for casting is preferably is composed of 17-4 steel alloy. Alternatively the main body 22 is composed of a titanium or a titanium alloy such as 6-4 titanium alloy, alpha-beta titanium alloy or beta titanium alloy for forging, and 6-4 titanium for casting. Additional methods for manufacturing the main body 22 include forming the body 22 from a flat sheet of metal, super-plastic forming the main body 22 from a flat sheet of metal, machining the main body 22 from a solid block of metal, electrochemical milling the main body 22 from a forged pre-form, and like manufacturing methods.

The golf club head 20 preferably has a volume from 100 cubic centimeters to 600 cubic centimeters, more preferably from 130 cubic centimeters to 475 cubic centimeters. When designed as a fairway wood, the golf club head 20 preferably has a volume ranging from 130 cubic centimeters to 300 cubic centimeters, and more preferably from 150 cubic centimeters to 275 cubic centimeters. The volume of the golf club head 20 will also vary between fairway woods (preferably ranging from 3-woods to eleven woods). When designed as a driver, the golf club head 20 preferably has a volume ranging from 300 cubic centimeters to 500 cubic centimeters, and more preferably from 420 cubic centimeters to 475 cubic centimeters.

The golf club head 20 preferably has a mass ranging from 90 grams to 250 grams, more preferably from 150 grams to 230 grams, and most preferably from 190 grams to 225 grams. The mass of the golf club head 20 will also vary between fairway woods (preferably ranging from 3-woods to eleven woods) and a driver.

In a preferred embodiment, the main body 22 has a crown portion 25, a partial heel portion 26, a partial toe portion 27, a partial rear portion 28, a partial sole portion 29 and a front portion 30. The minor body 24 preferably includes a sole wall 31, a partial heel wall 32, a partial toe wall 33 and a partial rear wall 34. The golf club head 20 preferably has a hollow interior. The golf club head 20 has a heel end 36, a toe end 38 an aft end 37. A shaft, not shown, is placed within a hosel 39 at the heel end 36.

The main body preferably has a mass ranging from 100 grams to 150 grams, and is most preferably 122 grams. The main body 22 preferably has a material volume ranging from 12.0 cubic centimeters to 20 cubic centimeters, and is most preferably approximately 16.0 cubic centimeters.

The front portion 30 of the main body 22 preferably has a thickness ranging from 0.050 inch to 0.125 inch, more preferably from 0.075 inch to 0.100 inch, and most preferably 0.080 inch to 0.090 inch. The partial heel portion 26, the partial toe portion 27, the partial rear portion 28, and the partial sole portion 29 each preferably has a thickness ranging from 0.020 inch to 0.050 inch, and most preferably approximately 0.030 inch. The crown portion 25 preferably has a thickness ranging from 0.020 inch to 0.050 inch, and most preferably approximately 0.030 inch.

The minor body 24 is a separate component which is attachable, preferably welded, to the main body 22. The minor body 24 is preferably composed of a tungsten alloy material, and preferably has a density ranging from 7.90 grams per cubic centimeters ("g/cc") to 18.5 g/cc, and more preferably from 8.25 g/cc to 12.5 g/cc. The tungsten alloy preferably comprises tungsten and at least one of nickel, iron and copper.

The minor body 24 preferably has a mass ranging from 80 grams to 100 grams, more preferably 90 grams to 95 grams. The minor body 24 preferably has a material volume ranging from 8.0 cubic centimeters to 12.0 cubic centimeters, and most preferably 10.0 cubic centimeters. The minor body 24 preferably has a thickness that ranges from 0.020 inch to 0.080 inch, more preferably from 0.030 inch to 0.070 inch, and even more preferably from 0.040 inch to 0.060 inch.

In general, the moment of inertia, Izz, about the Z axis for the golf club head 20 of the present invention will range from 1900 g-cm$^2$ to 3000 g-cm$^2$, preferably from 1990 g-cm$^2$ to 2800 g-cm$^2$, and most preferably from 1990 g-cm$^2$ to 2600 g-cm$^2$. The moment of inertia, Iyy, about the Y axis for the golf club head 20 of the present invention will range from 900 g-cm$^2$ to 1700 g-cm$^2$, preferably from 950 g-cm$^2$ to 1500 g-cm$^2$, and most preferably from 965 g-cm$^2$ to 1300 g-cm$^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as my invention:

1. A wood-type golf club head comprising:

a main body comprising a front portion, a crown portion, a partial toe portion, a partial heel portion, a partial rear portion and a partial sole portion, the main body composed of a stainless steel material, the main body having a mass ranging from 100 grams to 150 grams, the main body having a volume of 16.0 cubic centimeters, the front portion having a thickness ranging from 0.050 inch to 0.125 inch, the partial heel portion, the partial rear portion and the partial sole portion having a thickness ranging from 0.020 inch to 0.050 inch; and a minor body attached to the main body, the minor body comprising a sole wall, a partial toe wall, a partial heel wall and a partial rear wall, wherein the partial toe wall is welded to the partial toe portion, the partial heel wall is welded to the partial heel portion, the partial rear wall is welded to the partial rear portion, and the sole wall is welded to the partial sole portion, the minor body composed of a tungsten alloy material, the tungsten alloy material comprising stainless steel and tungsten, the minor body having a mass ranging from 80 grams to 100 grams;

wherein the golf club head has a mass ranging from 200 grams to 250 grams and wherein a moment of inertia, $I_{yy}$, a bout a Y axis of a center of gravity of the golf club head ranges from 900 g-cm$^2$ to 1700 g-cm$^2$.

2. The wood-type golf club head according to claim 1 wherein the tungsten alloy material further comprises nickel.

3. The wood-type golf club head according to claim 1 wherein the partial toe portion and the partial heel portion each has a length less than 25% of the length, L, of the golf club head.

4. The wood-type golf club head according to claim 1 wherein the minor body has a thickness ranging from 0.020 inch to 0.080 inch.

5. The wood-type golf club head according to claim 1 wherein the minor body has a material volume ranging from 6.0 cubic centimeters to 12.0 cubic centimeters.

6. A wood-type club head comprising:

a main body comprising a front portion, a crown portion, a partial toe portion, a partial heel portion, a partial rear portion and a partial sole portion, the main body composed of a stainless steel material, the main body having a mass of 116 grams, the main body having a volume of 16.0 cubic centimeters, the front portion having a thickness ranging from 0.050 inch t 0.125 inch, the partial heel portion, the partial rear portion and the partial sole portion having a thickness ranging from 0.020 inch to 0.050 inch; and a minor body attached to the main body, the minor body comprising a sole wall, a partial toe wall, a partial heel wall and a partial rear wall, wherein the partial toe wall is welded to the partial toe portion, the partial heel wall is welded to the partial heel portion, the partial rear wall is welded to the partial rear portion, and the sole wall is welded to the partial sole portion, the minor body composed of a tungsten alloy material, the tungsten alloy material comprising stainless steel and tungsten, the minor body having a mass of 92 grams;

wherein the golf club head has a mass of 211 grams wherein a moment of inertia, $I_{yy}$, about a Y axis of a center of gravity of the golf club head ranges from 900 g-cm$^2$ to 1700 g-cm$^2$.

* * * * *